US006018961A

United States Patent [19]

Venture et al.

[11] Patent Number: 6,018,961

[45] Date of Patent: Feb. 1, 2000

[54] COOLANT APPARATUS, AND ASSOCIATED METHOD, FOR COOLING AN ARTICLE

[76] Inventors: Darrell M. Venture; Darrell M. Venture, Jr., both of 100 Wilmington Cir., Clovis, N.Mex. 88101

[21] Appl. No.: 09/112,431

[22] Filed: Jul. 9, 1998

[51] Int. Cl.[7] ..... F25D 17/02

[52] U.S. Cl. ..... 62/434; 62/435; 62/94; 62/271

[58] Field of Search ..... 62/271, 94, 434, 62/435

[56] References Cited

U.S. PATENT DOCUMENTS

| | | | |
|---|---|---|---|
| 4,711,099 | 12/1987 | Polan et al. | 62/457 |
| 4,938,034 | 7/1990 | Rosanio et al. | 62/256 |
| 5,003,787 | 4/1991 | Zlobinsky | 62/185 |
| 5,170,633 | 12/1992 | Kaplan | 62/94 |
| 5,361,604 | 11/1994 | Peir et al. | 62/457.4 |
| 5,372,017 | 12/1994 | Zorea et al. | 62/457.9 |
| 5,447,039 | 9/1995 | Allison | 62/293 |
| 5,784,893 | 7/1998 | Furuhama et al. | 62/333 |
| 5,819,549 | 10/1998 | Sherwood | 62/246 |
| 5,823,010 | 10/1998 | Chao | 62/434 |
| 5,845,501 | 12/1998 | Stonehouse et al. | 62/62 |

*Primary Examiner*—Henry Bennett
*Assistant Examiner*—Mark Shulman
*Attorney, Agent, or Firm*—Robert H. Kelly

[57] ABSTRACT

Coolant apparatus, and an associated method, for quickly chilling an article, such as a beverage or food item. The article is placed in an enclosed compartment, and a forced flow of super-cooled air is directed upon the article. Heat energy of the article is convected thereaway.

18 Claims, 7 Drawing Sheets

| 13 DEC 97 | TEMPERATURE °F | | | |
|---|---|---|---|---|
| TIME | CORE | X = 1.3Y + 34 | OUTPUT | OAT |
| 1400 | -44 | -23.2 | -25 | 59 |
| 1430 | -44 | -23.2 | -24 | 54 |
| 1700 | -48 | -28.4 | -29.5 | 45 |
| 2000 | -50 | -31 | -31.7 | 42 |
| 2100 | -50 | -31 | -28.3 | 42 |
| 2230 | -52 | -33.6 | -32.3 | 42 |

COOLANT APPARATUS, AND ASSOCIATED METHOD, FOR COOLING AN ARTICLE

The present invention relates generally to coolant apparatus for cooling an article, such as a consumer drink or food item. More particularly, the present invention relates to apparatus, and an associated method, for quickly chilling the article well beneath ambient temperature levels. The article, initially at ambient, or greater, temperature levels is quickly chilled, avoiding the lengthy time periods conventionally required to chill an article.

A forced flow of air is chilled and, once chilled, is directed at the article. In one implementation, the forced flow of air is chilled to Fahrenheit temperatures well below freezing and directed towards the article at a suitable cubic feet per minute (CFM) flow rate. The article is cooled quickly as a result.

BACKGROUND OF THE INVENTION

The ability to refrigerate food stuffs is a virtual necessity of modern society. Few, if any, modern households are without some type of refrigeration apparatus by which to refrigerate food or beverage items. By maintaining temperatures of such items close to freezing temperatures, spoilage of such items can be delayed or prevented. Refrigeration apparatus capable of cooling an item beneath the freezing temperature, thereby to maintain the item in a frozen state, prevents spoilage of such items for even greater periods of time.

Refrigeration of food and beverage items also advantageously improves the taste and flavor of many of such items. Consumer beverages, such as juices, soft drinks, wine, and beer, e.g., are considered by many to be more tasteful and flavorful when chilled.

Conventional refrigeration apparatus includes an enclosed area forming a refrigeration compartment. The refrigeration compartment is maintained at a selected temperature, e.g., approximately 40° Fahrenheit. A food or beverage item, or other article, to be cooled is placed in the refrigeration compartment. Over time, the item, or other article, is cooled to be of the temperature at which the refrigeration compartment of the refrigeration apparatus is maintained.

Refrigeration apparatus conventionally utilized in many households is formed of a compression refrigerator. In such a compression refrigerator, advantage is taken of the relationship between pressure levels and the boiling point of a fluid, e.g., Freon (TM) which forms a refrigerant. Namely, when a liquid boils, the liquid absorbs heats energy. A compression refrigerator alternately compresses and condenses the fluid. The refrigerant is passed, e.g., by way of a coiled pipe, proximate to the refrigeration compartment. Heat energy of the compartment is transferred to the refrigerant. The refrigerant is then compressed and is provided to a condenser whereat the heat energy is transferred there away.

Another type of refrigeration apparatus, an absorption refrigerator, is analogously operable to cool the refrigeration compartment. In an absorption refrigerator, a compressor, however, is not required. Other types of refrigeration apparatus have been developed, e.g., a peltier refrigerator. Such apparatus is operable to reduce the temperature levels of a refrigeration compartment.

Conventional refrigeration apparatus typically utilized in most modern households, however, requires that an article to be cooled be placed in the refrigeration compartment of the refrigeration apparatus for an extended period of time to chill the article. Such an extended time period can be bothersome to a consumer of the food or beverage if the consumer must place the item in the enclosed area of the refrigeration apparatus and wait for the item to be chilled.

Microwave heating apparatus, in contrast, used to heat an item permits the item desired to be heated to be heated quickly. Consumer-usable coolant apparatus permitting analogous cooling of an item is not available.

A manner by which an article, such as a food or beverage item, could be more quickly cooled would therefore be advantageous.

It is in light of this background information related to coolant apparatus that the significant advantages of the present invention have evolved.

SUMMARY OF THE INVENTION

The present invention, accordingly, advantageously provides apparatus, an associated method, by which quickly to cool an article, such as a food or beverage item. The article is quickly chilled well beneath ambient temperature levels, avoiding the lengthy time periods conventionally required to chill an article.

The article to be cooled is placed in an enclosed compartment. A forced flow of air is supercooled. And, once supercooled, the forced flow of air is directed at the article. The forced flow of supercooled air directed at the article facilitates heat transfer of heat energy away from the article to be cooled.

In one implementation, the forced flow of air is supercooled to Fahrenheit temperatures well below freezing and is directed towards the article at a suitable CFM flow rate. At such temperatures, and at such rates, the article to be cooled is chilled in but a few minutes. For instance, a canned-beverage, such as a can of a commercially-available soft drink or beer, is chilled quickly through operation of an embodiment of the present invention. The can is placed in an enclosed area and positioned so that the forced flow of supercooled air is directed at the beverage can. The air is supercooled and directed towards the beverage can at a suitable flow rate. The beverage can, and the beverage contained therewithin, is quickly chilled.

In one implementation, the coolant apparatus is integrated into a conventional refrigerator to form a portion thereof. In another implementation, the coolant apparatus forms a free-standing unit. And, in another implementation, the coolant apparatus is used together with a conventional microwave heating device to form an integrated unit operable alternately to heat an article or to cool an article.

Operation of an embodiment of the present invention thereby provides a manner by which to cool quickly an article well beneath ambient temperature levels. A consumer of the article need not wait an extended period of time prior to consuming the article but rather is quickly able to chill the article and then consume the article, once chilled.

In these and other aspects, therefore, a coolant apparatus, and an associated method, cools an article. A primary-side refrigeration unit has a primary coolant coil for circulating a primary-side coolant fluid there through. A secondary-side coil is positioned in a heat transfer relation with the primary coolant coil of the primary-side refrigeration unit. The secondary-side coil has an air-ingress end side, an air-egress end side, and a central portion. The central portion is positioned in the heat transfer relation with the primary coolant coil. The secondary-side coil carries secondary-side coolant air, and heat energy of the secondary-side coolant air is transferable to the primary coolant coil and the primary-side coolant fluid carried therein. A blower is coupled to the secondary-side coil. The blower pumps the secondary-side coolant air through the secondary-side coil at a selected air flow rate. An article-receiving container is coupled to the air-ingress end side and the air-egress end side of the secondary-side coil. The article-receiving container supports the article therein such that the secondary-side coolant air flowing at the selected air flow rate exiting the air-egress side strikes the article, thereby to cool the article.

The present invention and the scope thereof can be obtained from the accompanying drawings which are briefly summarized below, the following detailed description of the presently-preferred embodiments of the invention, and the appended claims.

DETAILED DESCRIPTION

Figure 1:
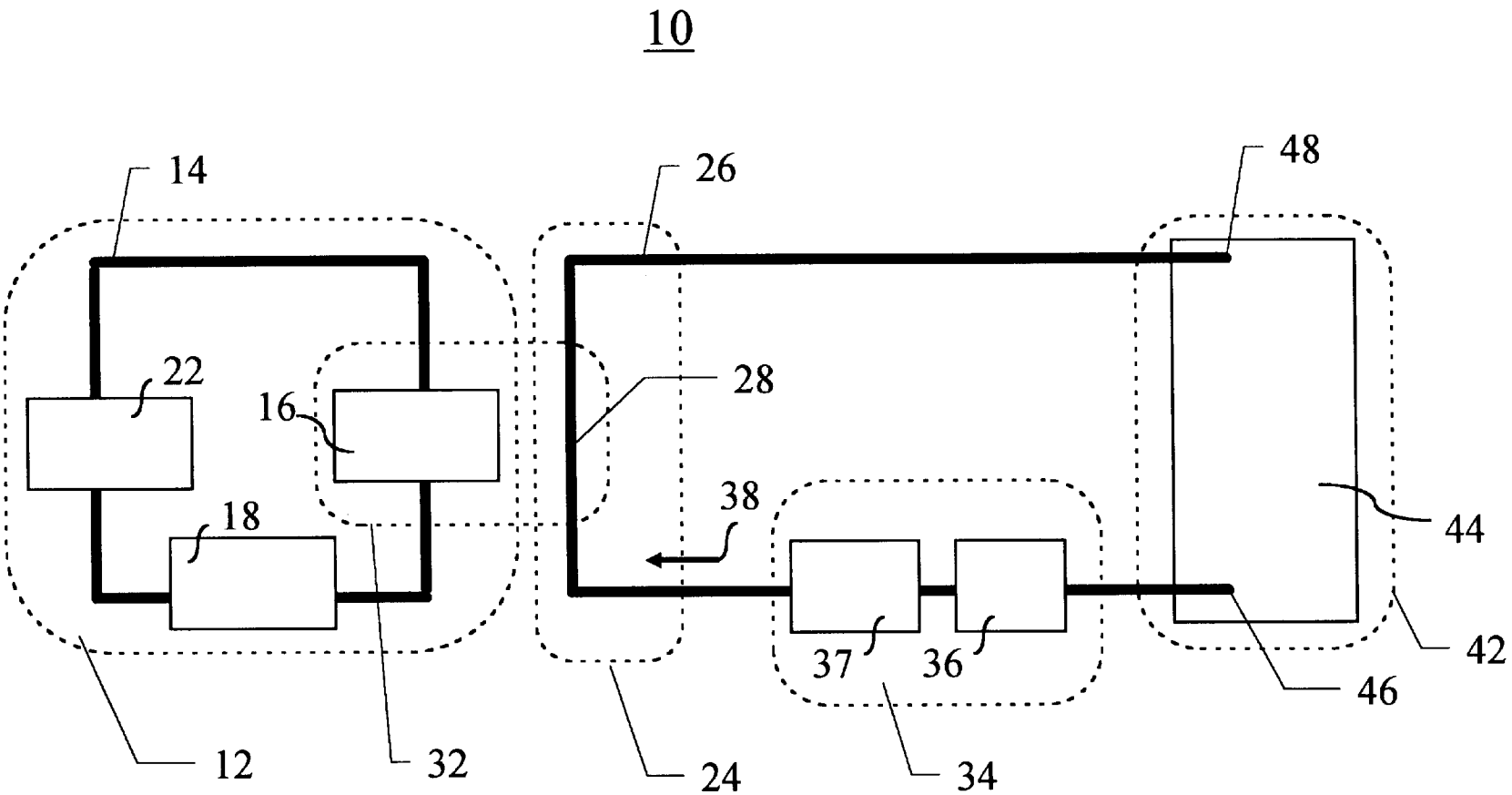
FIG. 1 illustrates a functional block diagram of the coolant apparatus of an embodiment of the present invention.

Referring first to FIG. 1, a coolant apparatus, shown generally at 10, of an embodiment of the present invention is operable to quickly chill an article well beneath ambient temperature levels. The article is chilled at a rate much quicker than the rate at which an article is chilled by conventional refrigeration apparatus. Through its operation, therefore, the coolant apparatus 10 permits an article to be chilled while avoiding the lengthy time periods conventionally required to chill the article.

The coolant apparatus 10 includes a primary-side refrigeration unit 12 which is operable pursuant to a refrigeration cycle. The primary-side refrigeration unit is here operable as a compression refrigerator which utilizes a refrigerant contained in tube 14 arranged in a closed-loop configuration. In the exemplary embodiment, the refrigerant contained in the tube 14 comprises Freon (tm) or other type of refrigerant.

The refrigeration unit 12 further includes an evaporator 16, a compressor 18, and a condenser 22, connected in-line, as shown, to act upon the refrigerant contained in the tube 14. In the top portion (as-shown) of the tube 14, the refrigerant is maintained under low pressure. Such low-pressure refrigerant is applied to the evaporator 16 whereat the refrigerant is evaporated into a gaseous state. The evaporation of the refrigerant lowers the temperature thereabout as heat energy is absorbed by the refrigerant as the refrigerant evaporates.

The compressor 18 is coupled to an evaporator 16 by another portion of the tube 14 and is operable to draw the refrigerant, in the gaseous state, away from the evaporator. The compressor 18 further compresses the refrigerant and passes the compressed refrigerant, by way of another portion of the tube 14, to the condenser 22. At the condenser, heat energy of the refrigerant is passed thereaway. And, as a result of increased pressure levels of the refrigerant due to operation of the compressor 18 and also due to the loss of heat at the condenser 22, the refrigerant condenses into liquid form. The refrigerant thereafter is passed again to the evaporator 16.

The coolant apparatus 10 further includes a secondary-side 24 including a coiled tube 26 having a central portion 28 positioned proximate to the evaporator 16 of the primary-side refrigeration unit 12. Such proximate positioning of the central portion 28 to the evaporator 16 positions the central portion 28 in a heat-transfer relation, indicated by 32, with the evaporator 16. The coiled tube 26 contains air which passes therethrough. As the air passes through the central portion 28 of the tube 26, heat energy of the air is drawn away through operation of the evaporator 16 upon the refrigerant passing therethrough. Thereby, the air is supercooled when passing through the coiled tube 26.

The coolant apparatus 10 further includes a pumping mechanism 34, here a blower 36, positioned in line with a desiccant 37 and the coiled tube 26 of the secondary-side unit 24. The blower 36 is operable to pump air through the coiled tube 26 at a selected air flow rate in the direction indicated by the arrow 38. Moisture is removed from the air before being supercooled as the air passes through the desiccant 37. As mentioned above, as the air contained in the tube 26 passes through the central portion 28, the air is supercooled. Continued operation of the blower 36 provides a continuous flow of air which is supercooled as the air flows through the central portion 28.

The coolant apparatus 10 further includes an article-receiving chamber 42 which includes an enclosable refrigeration compartment 44. End sides of the coiled tube 26 forming an air-ingress end 46 and an air-egress end 48, respectively, are positioned within the refrigeration compartment of the article receiving container 42. Air pumped by the blower 36 is supplied by way of the air-ingress end 46, and supercooled air is delivered by the air-egress end 48 to the refrigeration compartment 44.

The refrigeration compartment 44 is of dimensions permitting placement therein of an article to be cooled. The article is positioned proximate to the air-egress end 48 of the coiled tube 26 such that the chilled air flowing out of the air-egress end 48 is directed upon the article. Heat energy of the article is convected thereaway, thereby to quickly chill the article.

Figure 2:
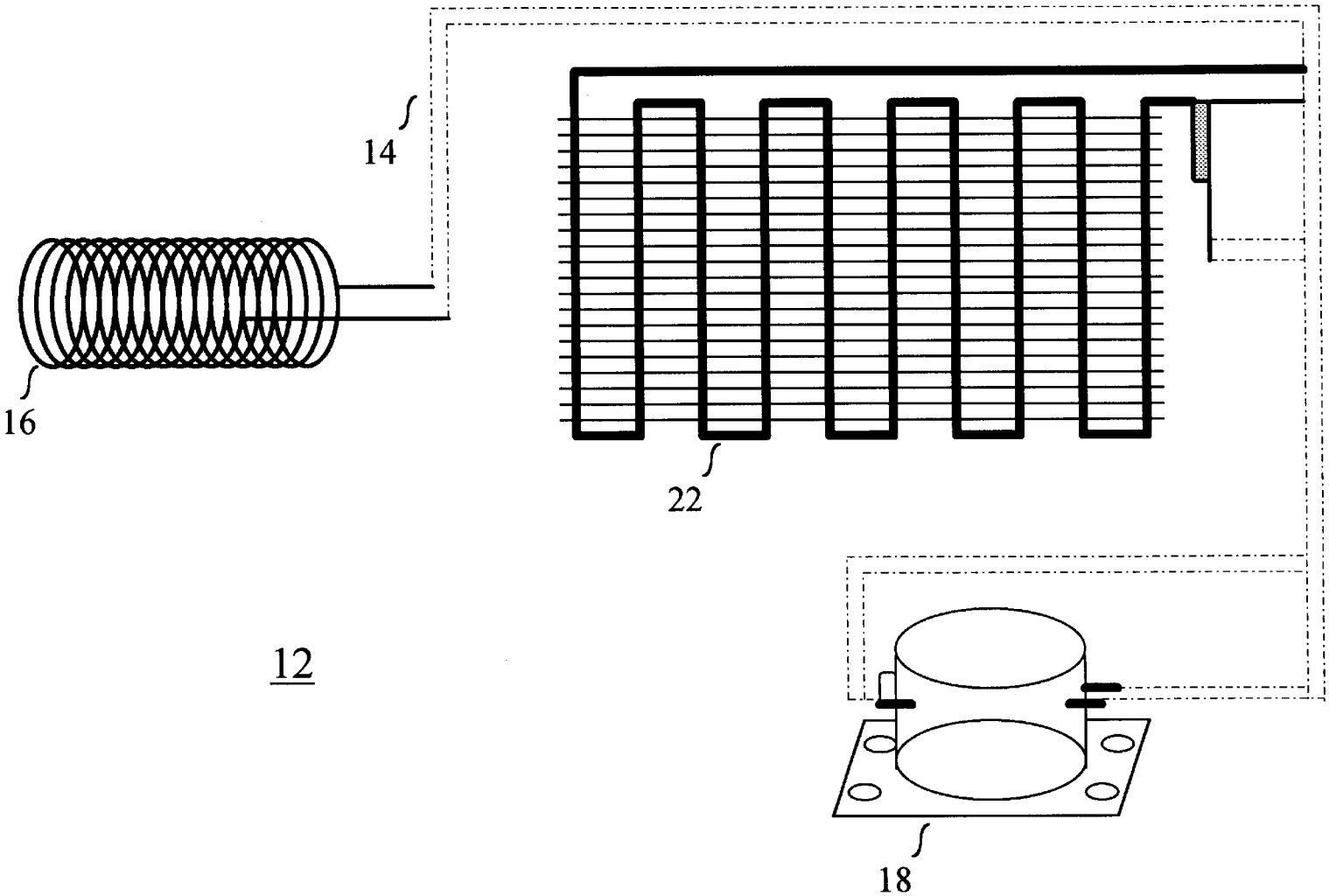
FIG. 2 illustrates a partial functional, partial perspective view of the primary-side refrigeration unit forming a portion of the coolant apparatus shown in FIG. 1.

FIG. 2 again illustrates the primary-side refrigeration unit 12, forming a portion of the coolant apparatus 10. The refrigeration unit 12 is again shown to include an evaporator 16, a compressor 18, and a condenser 22. The evaporator 16 is here formed of copper tubing, and the compressor 18 is formed of a ⅓ horsepower motor for maintaining the refrigerant contained in the tube in 14 at high pressures of 150 psi (pounds per square inch), a low-pressure side of 5–6 psi, and 3–5 psi back pressure. In other embodiments, the compressor is formed of other compressor-types having other compressor specifications. In the implementation illustrated in FIG. 2, the refrigerant is formed of 5.5 ounces of R-12 Freon (tm).

Figure 3:
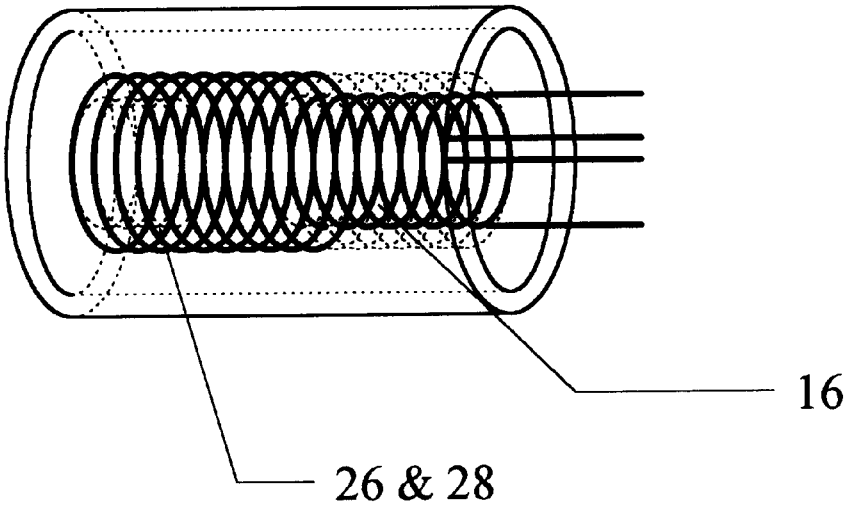
FIG. 3 illustrates a partial functional, partial perspective view of the heat transfer unit and the secondary-side refrigeration unit forming portions of the coolant apparatus shown in FIG. 1.

FIG. 3 illustrates again the evaporator 16 and portions of the coiled tube 26 positioned in the heat-transfer relation therebetween. Here, the evaporator is shown to be formed of a 50 foot coil of copper tubing, ⅜ inch outside diameter, 0.003 inch thickness. The coiled tube 26, and the central portion 28 thereof, is here shown to be formed of a 20 foot coil of flexible tubing having a 1 and 9/16 inch outside diameter, ⅛ inch thickness. In other embodiments, the evaporator is formed to be of other specifications. The evaporator 16 and the central portion 28 of the coiled tube 26 is immersed in a mixture of antifreeze, e.g., ethylene glycol, and water. In the exemplary implementation, the ratio of antifreeze to water is 7:3. Five gallons of the fluid mixture is used in the exemplary implementation, an amount permitting the evaporator 16 and central portion 28 to be substantially immersed therein.

The coil forming the evaporator 16 reduces the antifreeze mixture to a cold level to facilitate transfer of heat energy away from air flowing through the central portion 28 of the coiled tube 26, thereby to chill the air. Installation about, and a top cover for, the container holding the antifreeze mixture, the evaporator 16, and the central portion 28 of the coil 26 further facilitates maintenance of the antifreeze mixture at the low temperature.

Figure 4:
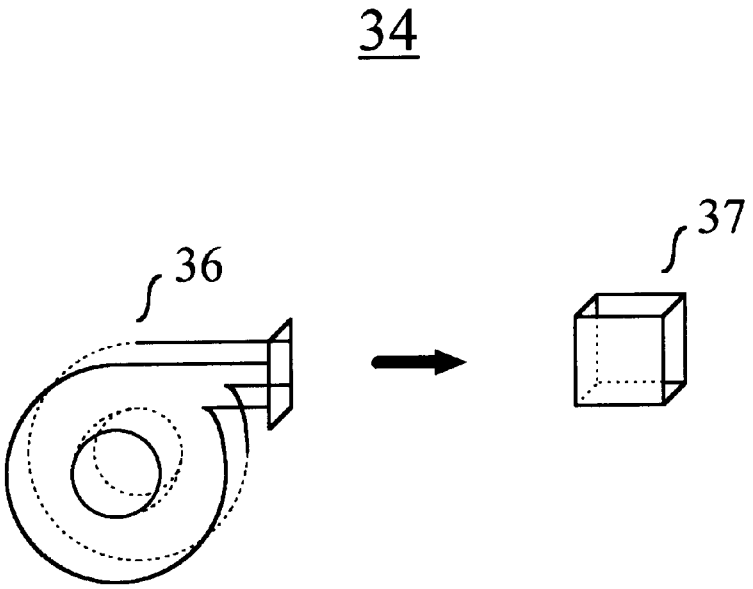
FIG. 4 illustrates a partial functional, partial perspective view of the blower forming a portion of the coolant apparatus shown in FIG. 1.

FIG. 4 again illustrates the blower 36 and desiccant 37 to form the pumping mechanism 34. In one exemplary implementation illustrated in the Figure, the blower 36 is formed of a 100 cubic feet per minute (cfm) blower for pushing the air through the coiled tube 26. In such an exemplary embodiment, the blower 36, desiccant 37, coiled tube 26, and refrigeration compartment 44 form a closed system. In another embodiment, the blower is coupled in an open system. That is to say, in another embodiment, the air-ingress end 46 of the coiled tube 26 does not extend to the refrigeration compartment.

Figure 5:
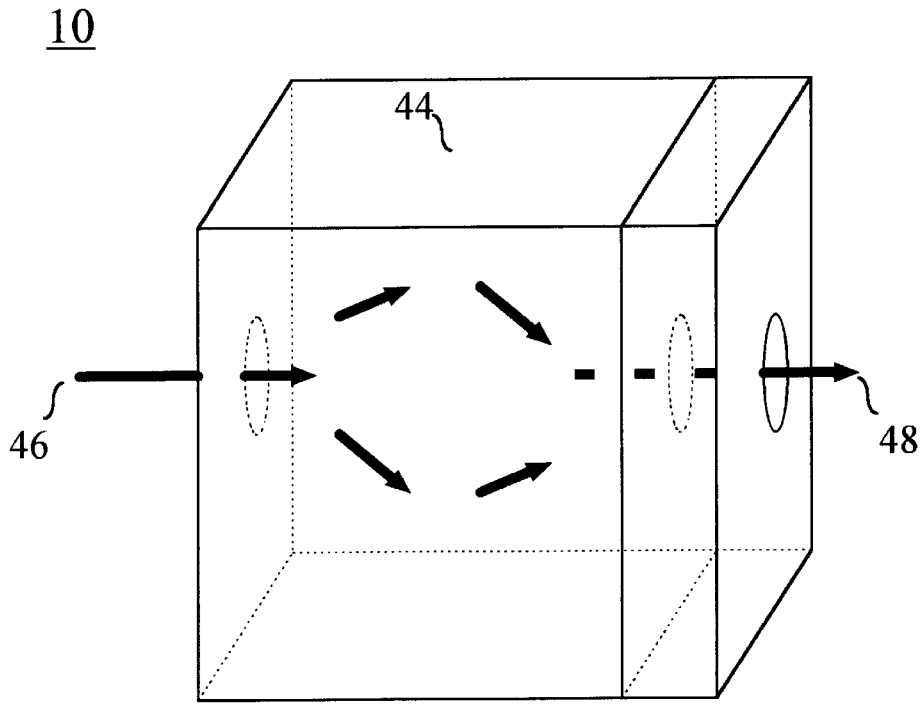
FIG. 5 illustrates a partial functional, partial perspective view of an article-receiving container forming a portion of the coolant apparatus shown in FIG. 1.

FIG. 5 illustrates again the article-receiving container 42 which forms a portion of the coolant apparatus 10 shown in FIG. 1. The article-receiving container is box-like in configuration and includes an inner chamber forming the refrigeration compartment 44. The air-ingress and air-egress ends 46 and 48 of the coiled tube 26 are also shown in the Figure. By placing an article, such as a consumer-drinkable beverage or food item, in the refrigeration compartment 44 and then operating the coolant apparatus to direct a forced flow of coolant air upon the article, the article is quickly chilled to a temperature well beneath ambient temperature levels. Chilling of the article is thereby achieved without the need to wait a lengthy time for the article to be chilled.

Figure 6:
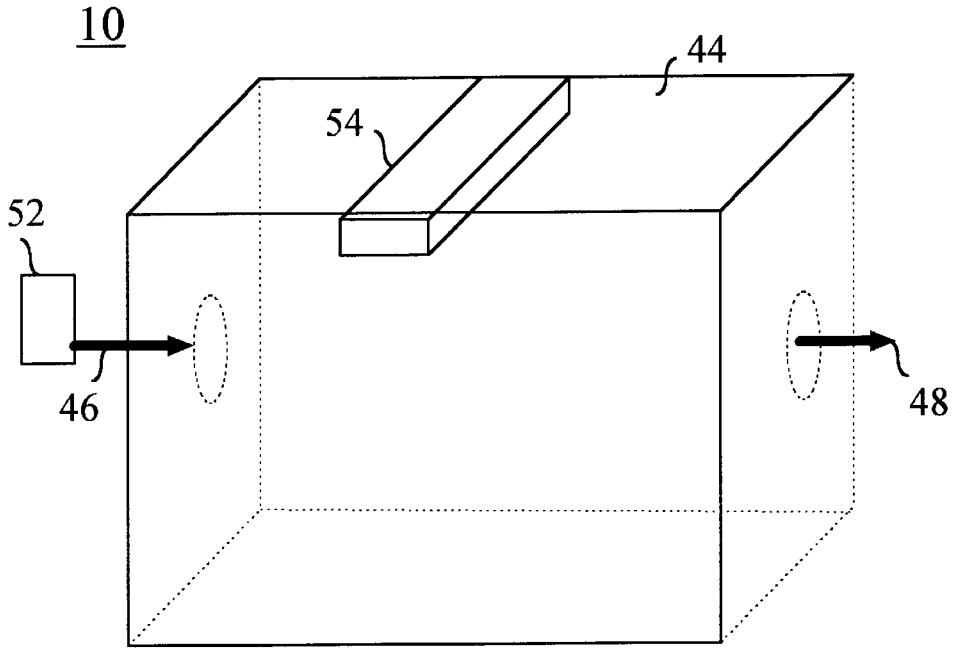
FIG. 6 illustrates a partial functional block, partial perspective view of the coolant apparatus of a further embodiment of the present invention.

FIG. 6 illustrates the apparatus 10 of another embodiment of the present invention. Here, the apparatus is selectably operable alternately to cool an article or to heat an article placed within the compartment 44.

The apparatus 10 is again shown to include air ingress and egress ends 46 to provide for the flow of supercooled air through the compartment 44. The primary and secondary side refrigeration units 12 and 24 and the pumping mechanism 34 are here identified by a single block 52. Such elements, in an exemplary implementation, correspond to those shown and described previously with respect to FIGS. 1–5.

The apparatus 10 here further includes a microwave element 54, operable in conventional manner to generate microwave energy. The microwave energy, when transferred to an article placed in the compartment 44 heats the article.

The user selects operation of the apparatus 10, by way of an input actuator (not shown) alternately to cool an article or to heat an article placed in the compartment 44.

Figure 7:
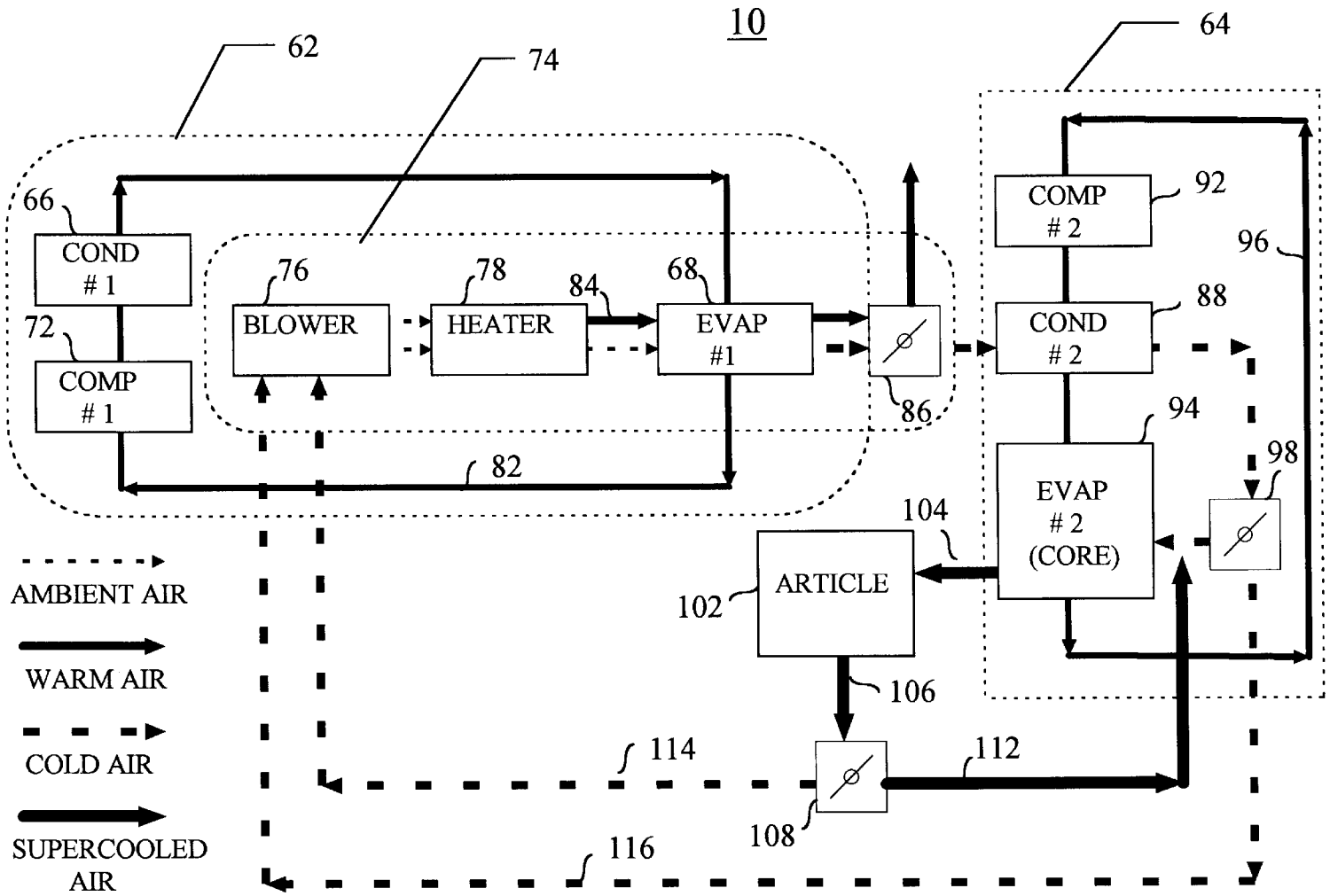
FIG. 7 illustrates a functional block diagram of the coolant apparatus of another embodiment of the present invention.

FIG. 7 illustrates the coolant apparatus, shown generally at 10, of another embodiment of the present invention. In this embodiment, the coolant apparatus forms a cascade refrigeration unit, here including a primary side refrigeration unit 62 and a secondary side refrigeration unit 64. Analogous to the primary side refrigeration unit 12 of the embodiment shown in FIG. 1, the primary side refrigeration unit 62 includes a condenser 66 coupled in-line with an evaporator 68 and a compressor 72. The primary side refrigeration unit 62 further includes a dehumidification and defrost unit 74 including a blower 76 and a heater 78.

The condensor 66, evaporator 68, and compressor 72 are again operable in a closed-loop configuration to function as a compression refrigerator utilizing a refrigerant contained in the tube 82. In the top portion (as-shown) of the tube 82, the refrigerant is maintained at a low pressure. Such low-pressure refrigerant is applied to the evaporator 68 whereat the refrigerant is evaporated into a gaseous state. The evaporation of the refrigerant lowers the temperature thereabout as heat energy is absorbed by the refrigerant as the refrigerant evaporates.

The compressor 72 is coupled to the evaporator 68 by another portion of the tube 82 and is operable to draw the refrigerant away from the evaporator. The compressor 72 further compresses the refrigerant and passes the compressed refrigerant, by way of another portion of the tube 82, to the condensor 66. Heat energy of the refrigerant is extracted through operation of the condenser which increases the pressure levels of the refrigerant to place the refrigerant back in liquid form.

The dehumidification and defrost unit 74 is operable to defrost the coils of which the evaporator 68 is formed. The blower 76 intermittently generates a forced air flow which is applied to the heater 78 which generates defrost air on the line 84 to defrost the coils of the evaporator 68.

When the unit 74 is not being operated to defrost the coils of the evaporator 68, the heater 78 is turned off, and forced air flow generated by the blower 76 is cooled as the air passes over the coils of the evaporator 68. The cooled air is passed through a valve 86 which connects the primary and secondary side refrigeration units 62 and 64 theretogether.

The secondary side refrigeration unit 64 is here shown to include a condensor 88, a compressor 92, and an evaporator 94, connected in-line with one another. The condenser 88, compressor 92, and evaporator 94 also function as a compression refrigerator which also utilizes a refrigerant, here contained in the tube 96. Cooled air generated by the primary side refrigeration unit is passed, via appropriate positioning of the valve 98 over the evaporator 94 to cool further the already-cooled air, cooled by the primary side refrigeration unit 62. Thereafter, the twice-cooled air is provided to the refrigeration compartment 102 by way of the coolant air ingress line 104. An article placed in the refrigeration compartment 102 is quickly cooled thereby.

In the illustrated embodiment, an air egress line 106 is coupled to a valve 108 which alternately recirculates the air by way of the line 112 back over the coils of the evaporator 94, or, by way of the line 114 back to the blower 76 of the primary side refrigeration unit 62. The position of the valve 108 may, for instance, be determined by the temperature of the air exiting the refrigeration compartment 102.

The line 116 is further illustrated in the figure. The line 116 provides a path for the flow of air exiting the condenser 88 back to the dehumidification and defrost unit 74, depending upon the position of the valve 98.

Figure 8A:
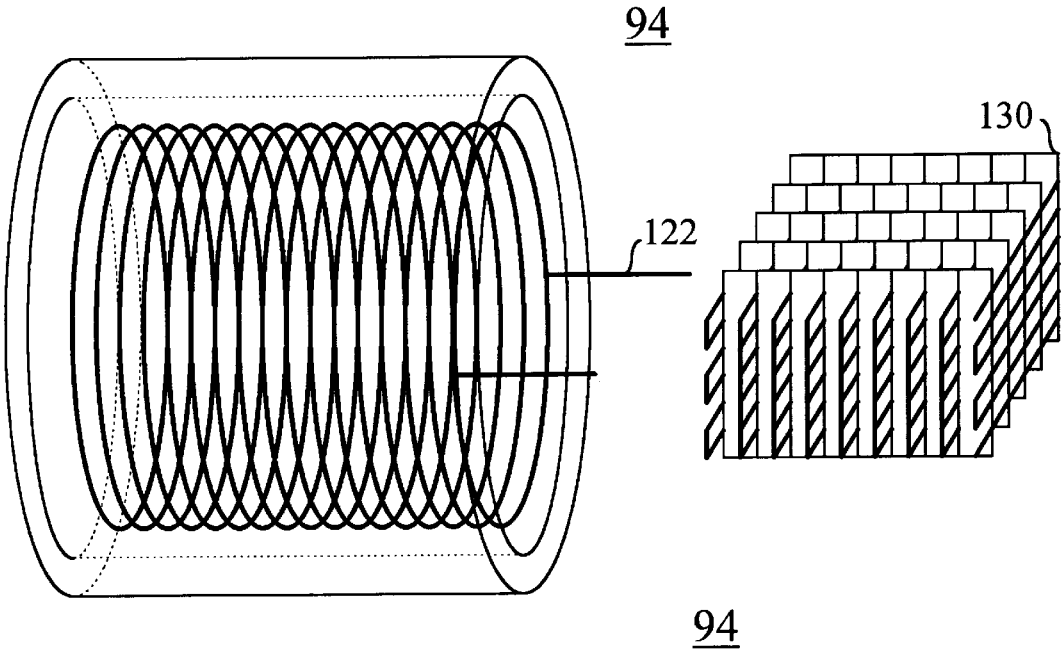
FIGS. 8A and 8B illustrate exploded, perspective and sectional views of a portion of the coolant apparatus shown in FIG. 7.
Figure 8B:
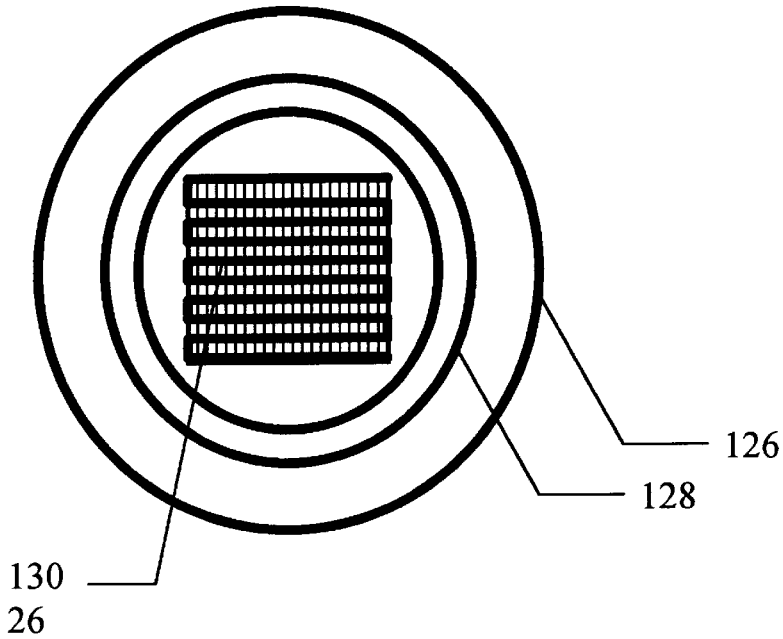

FIGS. 8A and 8B illustrate exploded, perspective and sectional views of the evaporator 94 of the secondary side refrigeration unit 64 of an embodiment of the present invention. Here, the evaporator is shown to be tubular in construction with a coiled tube 122 positioned within a tubular enclosure defined by an outer casing 126 and an inner casing 128. A finned-type heat exchanger 130 is positioned within the coiled tube 122 in a heat transfer arrangement to permit heat exchange between cooled air flowing through the tube 122 and the exchanger 130.

Figures 9, 10:
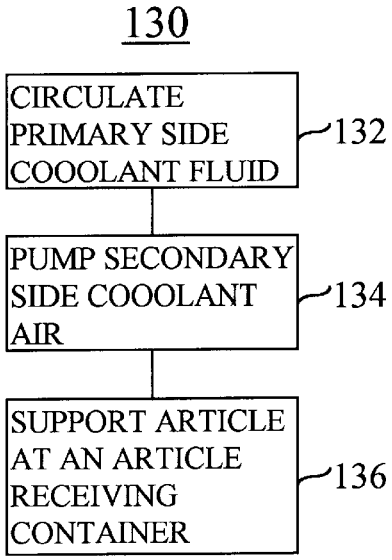
FIG. 9 illustrates a method flow diagram listing the method steps of the method of an embodiment of the present invention.
FIG. 10 illustrates a table showing temperature levels at various portions of the coolant apparatus shown in FIG. 1 during operation of the coolant apparatus of an embodiment of the present invention.

FIG. 9 illustrates a method, shown generally at 130, of an embodiment of the present invention. First, and as indicated by the block 132, a primary-side coolant fluid is circulated through a primary coolant coil of a primary-side refrigeration unit. Then, and as indicated by the block 134, a secondary-side coolant air is pumped through a secondary-side coil at a selected air flow rate. The secondary side coil has an air-ingress side, an air-egress side, and a central portion. The central portion is positioned in a heat-transfer relation with the primary coolant coil wherein heat energy of the secondary-side coolant air is transferable to the primary coolant coil and the primary-side coolant fluid carried therein.

Then, and as indicated by the block 136, the article is supported at an article-receiving container. The article-receiving container is coupled to the air-ingress end side and the air-egress end side of the secondary-side coil such that the secondary-side coolant air flowing at the selected air flow rate exiting the air-egress end side strikes the article.

FIG. 10 illustrates cooling achieved during operation of the coolant apparatus 10 of an embodiment of the present invention. Once the primary-side refrigeration unit 12 is operable for a time period to chill the antifreeze mixture in which the evaporator 16 and central portion 28 are immersed, the heat-transfer relation 32 permits nearly immediate cooling of air flowing through the coiled tube 26. As the table indicates, when the temperature of the antifreeze mixture is maintained at a temperature of −52° F., and ambient air of temperatures of approximately 42° F., the coolant apparatus is operable to chill the air to temperatures well beneath 0° F., e.g., −32 degrees Fahrenheit, a temperature gradient of 74° F. Application of air cooled to such temperatures, when directed upon an article to be chilled, quickly cools the article.

The previous descriptions are of preferred examples for implementing the invention, and the scope of the invention should not necessarily be limited by this description. The scope of the present invention is defined by the following claims.

What is claimed is:

1. Coolant apparatus for cooling an article, said coolant apparatus comprising:

a primary-side refrigeration unit having a primary coolant coil, the primary coolant coil for circulating a primary-side coolant fluid therethrough;

a secondary-side coil having an air-ingress end side, an air-egress end side, and a central portion, the central portion positioned in a heat transfer relation with the primary coolant coil of said primary-side refrigeration unit, said secondary-side coil for carrying secondary-side coolant air, heat energy of the secondary-side coolant air transferable to the primary coolant coil and the primary-side coolant fluid carried therein;

a tub containing a fluid having a freezing point at least as low as temperatures exhibited by the primary coolant coil, at least portions of the primary coolant coil and said secondary-side coil immersed in said liquid a blower coupled to said secondary-side coil, said blower for pumping the secondary-side coolant air through said secondary-side coil at a selected air flow rate; and an article-receiving container coupled to the air-ingress end side and the air-egress end side of said secondary-side coil, said article-receiving container for supporting the article therein such that the secondary-side coolant air flowing at the selected air flow rate exiting the air-egress side strikes the article, thereby to cool the article.

2. The coolant apparatus of claim 1 wherein said primary-side refrigeration unit further comprises a compressor and a condenser, said compressor for compressing the primary-side coolant fluid.

3. The coolant apparatus of claim 2 wherein said compressor is positioned in-line with the primary coolant coil in a closed-loop configuration, the compressor defining a high-pressure side and a low-pressure side of the primary coolant coil.

4. The coolant apparatus of claim 3 wherein the high-pressure side is maintained at a pressure of at least 150 pounds per square inch.

5. The coolant apparatus of claim 3 wherein the low-pressure side is maintained at a pressure at least as low as 6 pounds per square inch.

6. The coolant apparatus of claim 1 wherein the primary-side coolant fluid comprises a Freon (tm)-based material.

7. The coolant apparatus of claim 1 wherein said secondary-side coil includes at least a portion which physically abuts against the primary coolant coil of said primary-side refrigeration unit.

8. The coolant apparatus of claim 1 wherein the liquid comprises a water-ethylene glycol mixture.

9. The coolant apparatus of claim 1 wherein the liquid has a freezing point at least as low as −85 degrees Fahrenheit.

10. The coolant apparatus of claim 1 wherein said blower comprises an electric-blower motor.

11. The coolant apparatus of claim 1 wherein the selected air flow rate at which said air pump pumps the secondary side coolant air comprises a nominal rate of 100 cubic feet per minute.

12. The coolant apparatus of claim 1 wherein said article-receiving container defines an inner chamber, the article supported within the inner chamber.

13. The coolant apparatus of claim 12 wherein the article comprises a can of a consumer-drinkable beverage and wherein the inner chamber defined by said article-receiving chamber is of dimensions at least large enough to support the can.

14. The coolant apparatus of claim 4 further comprising a microwave heating element positioned at said article-receiving container, said microwave heating element selectably operable to generate microwave-frequency energy for selectably heating the article positioned at said article receiving container.

15. The coolant apparatus of claim 1 further comprising a defroster positioned to direct defrost air upon at least a portion of said primary-side refrigeration unit, said defroster for selectably defrosting the portion of said primary-side refrigeration unit.

16. The coolant apparatus of claim 1 further comprising a secondary-side refrigeration unit, said secondary-side coil forming a portion of said secondary-side refrigeration unit and wherein said primary-side refrigeration unit and said secondary-side refrigeration unit together form a cascade refrigerator.

17. A method for cooling an article, said method comprising the steps of:

positioning at least a portion of a primary coolant coil of a primary-side refrigeration unit and a secondary side coil in a tub containing a liquid having a freezing point at least as low as temperatures exhibited by the primary coolant coil;

circulating primary-side coolant fluid through the primary coolant coil of the primary-side refrigeration unit;

pumping secondary-side coolant air through the secondary-side coil at a selected air flow rate, the secondary-side coil having an air-ingress side, an air-egress side, and a central portion, the central portion positioned in a heat-transfer relation with the primary coolant coil, heat energy of the secondary-side coolant air transferable to the primary coolant coil and the primary-side coolant fluid carried therein; and supporting the article at an article-receiving container, the article-receiving container coupled to the air-ingress end side and the air-egress end side of the secondary-side coil such that the secondary-side coolant air flowing at the selected air-flow rate exiting the air-egress end side strikes the article, thereby to cool the article.

18. Coolant apparatus for cooling a container containing a consumer beverage, said coolant apparatus comprising:

means for circulating a forced coolant air flow at an air flow rate of at least 100 feet per minute at a primary side of a refrigeration unit;

means for carrying secondary-side coolant air, heat energy of the secondary-side coolant air transferable to the coolant air circulating at the primary side; means for immersing at least portions of the primary side of said means for circulating and said means for carrying in a tub of liquiding having a freezing point at least as low as temperatures exhibited by the primary coolant coil, thereby to cool the forced coolant air flow generated by said means for generating to a temperature of at least minus forty degrees Fahrenheit;

means for applying the forced coolant air flow, once cooled by said means for cooling, to the container containing the consumer beverage, thereby to cool the container, and the consumer beverage contained therein.

* * * * *